US005091927A

United States Patent [19]

Golitzer et al.

[11] Patent Number: 5,091,927

[45] Date of Patent: Feb. 25, 1992

[54] X-RAY TUBE

[75] Inventors: Rolf Golitzer, Ammersbek; Lothar Weil, Hamburg, both of Fed. Rep. of Germany

[73] Assignee: U.S. Philips Corporation, New York, N.Y.

[21] Appl. No.: 618,350

[22] Filed: Nov. 26, 1990

[30] Foreign Application Priority Data

Nov. 29, 1989 [DE] Fed. Rep. of Germany ..... 8914064

[51] Int. Cl.[5] ..... H01J 35/10

[52] U.S. Cl. ..... 378/130; 378/132

[58] Field of Search ..... 378/130, 141, 132, 133

[56] References Cited

U.S. PATENT DOCUMENTS 3,694,685 9/1972 Houston .

4,622,687 11/1986 Whitaker et al. ..... 378/130

4,945,562 7/1990 Staub ..... 378/130

OTHER PUBLICATIONS

Prof. Dr. G. J. van der Plaats, "Leitfaden Der Medizinischen Rontgentechnik", Phililps Technische Bibliothek, (1961), pp. 34–35.

*Primary Examiner*—Craig E. Church

*Attorney, Agent, or Firm*—William Squire

[57] ABSTRACT

An X-ray tube includes an anode member having a cylindrical cavity connectable to a cooling medium flow. A cooling device (14) in the cavity distributes the cooling medium with turbulent flow and which comprises a tube (141) on the outer faces of which there are mounted spaced apertured cooling medium guide discs (142, 144) constructed so that the cooling medium flows around the tube over the discs and through their apertures in the space between the anode member (8) and the tube (141).

11 Claims, 2 Drawing Sheets

X-RAY TUBE

BACKGROUND OF THE INVENTION

The invention relates to an X-ray tube which comprises an anode member provided with a cylindrical cavity which can be connected to a cooling medium flow. An X-ray tube of this kind is known from the publication "Leitfaden der medizinischen Rötgentechnik" by van der Plaats,1961, FIG. 21. This tube is an X-ray tube comprising a stationary anode. The stationary anode is provided with a cavity which is penetrated by a cooling medium supply duct. The cooling medium flows through the duct to the end face of the cavity on which the stationary anode is mounted, and subsequently flows back along the cooling medium duct in the cavity. Of interest is commonly owned copending application entitled "Rotary-Anode X-ray Tube Comprising A Sleeve Bearing, Notably A Helical-Groove Bearing", Ser. No. 07/459,914, filed Jan. 2, 1990 in the name of AXEL VETTER.

SUMMARY OF THE INVENTION

It is an object of the present invention to construct an X-ray tube of the kind set forth so that suitable cooling is achieved also at the surfaces of the cylindrical cavity. This object is achieved in accordance with the invention in that in the cavity there is arranged a cooling device which serves to distribute the cooling medium flow and which comprises a tube on the outer surfaces of which there is mounted a cooling medium guide device which is constructed so that the cooling medium flows around the tube in the space between the anode member and the tube.

The cooling medium guide device prevents the cooling medium from flowing exclusively in the longitudinal direction of the tube in the space between the tube and the inner surfaces of the anode member which bound the cylindrical cavity and forces the cooling medium to flow around the tube. Turbulences are thus induced in the cooling medium flow on the inner surfaces, resulting in improved cooling.

The cooling medium guide device in one embodiment helically encloses the tube and whose outer dimensions are adapted to be received in the aperture in the anode member. The manufacture of such a device, however, is complex. Therefore, a further embodiment comprises one where the cooling medium guide device includes several discs which extend transversely of the longitudinal axis of the tube and which form an opening for the passage of the cooling medium, the openings of neighboring discs each being approximately 180° offset with respect to one another. The cooling medium flow can thus reach the space between a disc and the next disc only through an opening in the first disc. Because the openings in successive discs are each 180° offset (with respect to the longitudinal axis of the tube), the cooling medium flow is forced to flow around the tube in an arc of 180° from one opening to another.

A preferred embodiment comprises a rotary anode journalled by a bearing having a rotating bearing portion and a stationary bearing portion, a liquid cooling medium being present between the bearing portions. The stationary bearing portion has a cylindrical cavity which opens towards the exterior and in which the cooling device is received. The described rotary-anode X-ray tubes, notably tubes comprising a helical groove bearing, exhibit a temperature distribution during operation which necessitates effective cooling of the cylindrical surfaces of the cavity in the anode member.

BRIEF DESCRIPTION OF THE DRAWINGS

The invention will be described in detail hereinafter with reference to the drawing. Therein.

DESCRIPTION OF THE PREFERRED EMBODIMENT

Figure 1:
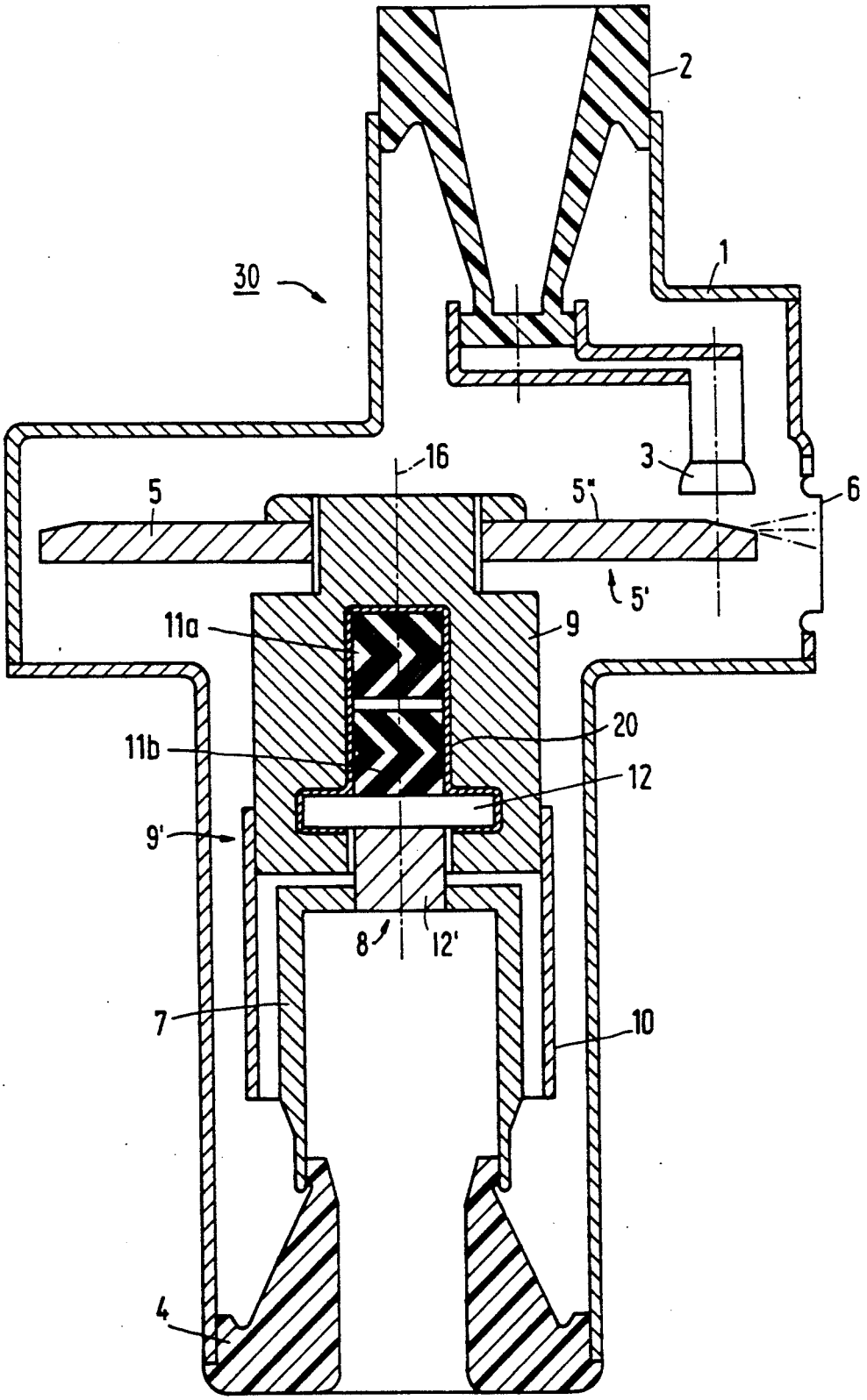
FIG. 1 shows a sectional elevation view of an X-ray tube in which the invention can be carried out.
Figure 3:
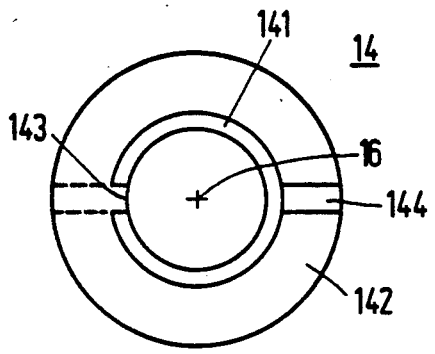
FIG. 3 is a plan view of the cooling device.

The rotary-anode X-ray tube 30 shown in FIG. 1 comprises a metal envelope 1 whereto a cathode 3 is secured via a first insulator 2, the rotary anode assembly 5' being secured thereto via a second insulator 4, which may be ceramic. The rotary anode assembly 5' comprises an anode 5 whose surface 5'' which faces the cathode 3 emits X-rays when a high voltage is applied. The X-rays emerge via a radiation exit window 6 in the envelope 1. The window 6 is preferably made of beryllium. The anode disc 5 is connected to a support 7 via a bearing system 9' which is connected to the second insulator 4. The bearing system 9' comprises a stationary bearing portion 8 which is connected to the support 7 and a rotating bearing portion 9 whose lower end includes a rotor 10 for driving the anode disc 5 connected to its upper end. The bearing portions 8, 9 may comprise a molybdenum alloy (TZM).

At its upper end, the bearing portion 8 has two fishbone-like groove patterns **11*a*, 11*b* which are offset with respect to one another in the axial direction parallel to axis 161. The grooves of groove patterns 11*a*, 11*b* have a depth of, for example, 10 μm and the ratio of the surface areas of the grooves to the intermediate surface areas is, for example 1:1. The space between the groove patterns 11*a*, 11*b* and the bearing portion 9 is filled with a liquid lubricant 20' preferably a gallium alloy. The surfaces of the stationary bearing portion 8 which are provided with the groove patterns 11*a*, 11*b* and the facing surfaces of the rotating bearing portion 9** thus form two helical groove bearings for taking up the radial bearing forces.

Adjacent the lower helical groove bearing, the bearing portion 8 comprises a section 12 which has a thickness of several mm and whose diameter is substantially larger than the diameter of the remainder of the bearing portion 8. The section 12 is followed by a section 12' whose diameter at least substantially equals the diameter of the top part of the bearing portion 8 and which is connected to the support member 7. The inner contour of the bearing portion 9 matches the outer contour of the bearing portion 8. Consequently, the rotating bearing portion 9 cannot be constructed as an integral unit as diagrammatically shown in the drawing, but must comprise at least two parts (not shown) which are suitably interconnected at the area of the section 12 in order to captivate section 12.

The end faces of the section 12 which extend transversely of the axis of rotation 16 of the bearing portion 9 are also provided with a fishbone-type pattern (not shown in the drawing) and constitute, in conjunction with the parallel matching faces of the bearing portion 9, two further helical groove bearings which are capable of taking up axially directed forces on the rotary anode in directions parallel to axis 16.

During X-ray exposures, possibly in conjunction with fluroscopy, the anode disc 5 is heated to relatively high temperatures. This heat is partly radiated off by the anode assembly 5, and partly applied across the rotating bearing portion 9. This heat also heats the stationary bearing portion 8, the highest temperatures occurring in the section 12.

Figure 2:
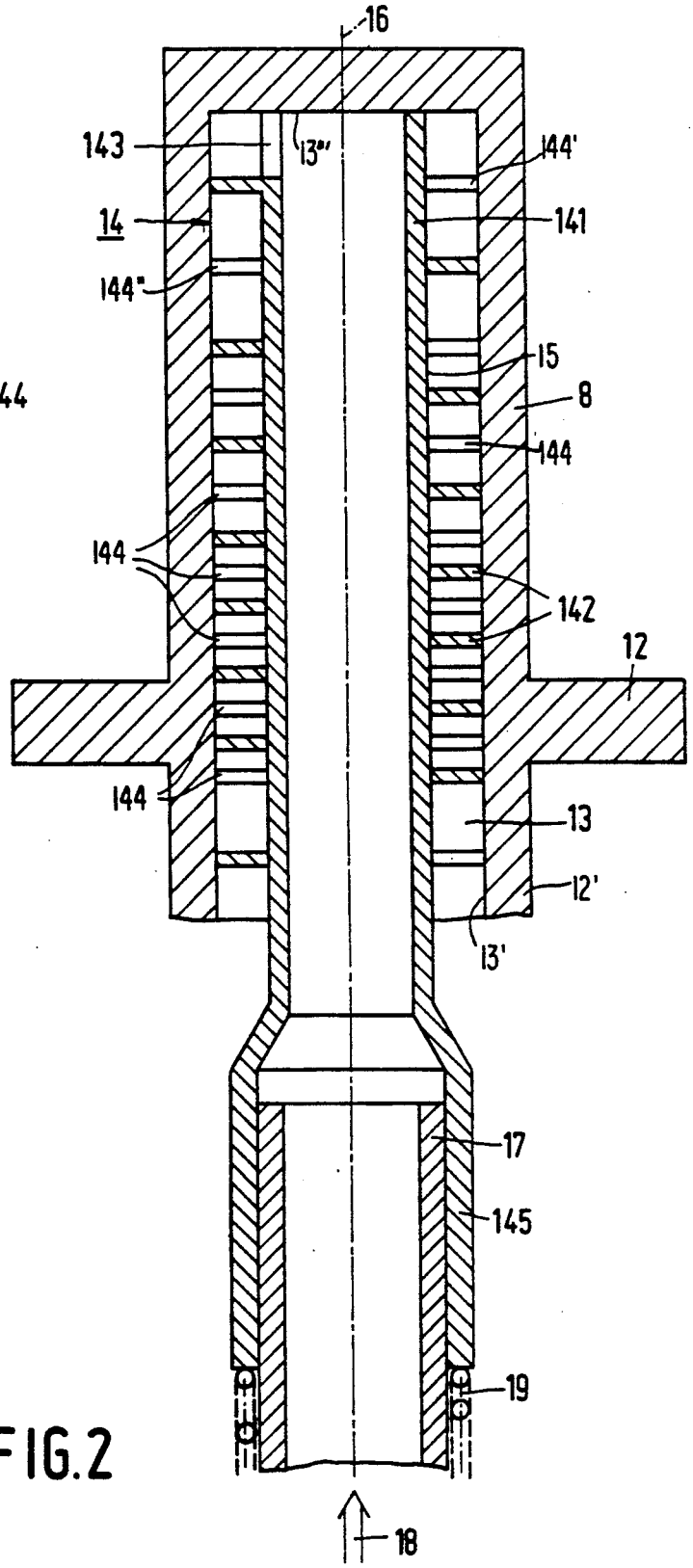
FIG. 2 shows a sectional elevation of a cooling device in accordance with an embodiment of the invention in a part of the X-ray tube of FIG. 1

FIG. 2 shows the stationary bearing portion 8 and the cooling device 14 accommodated therein. The bearing portion 8 comprises a cavity 13 having a circular-cylindrical surface 13' and flat end faces 13" (only one being shown) which are perpendicular the axis 16. The inner diameter of the cavity 13 amounts to, for example 20 mm.

In the cavity 13 there is cooling device 14 which comprises a metal tube 141, on the outer surface 15 of which there are secured a number of discs 142 which lie in planes perpendicular to the axis of rotation 16 and whose outer diameters corresponds substantially to the inner diameter of the cavity 13 or may be a few tenths of a mm smaller than the diameter of the cavity 13. At its end which faces the end face 13 of the stationary bearing portion 8, the cooling device 14 tube 141 has an opening 143. Moreover, each disc 142 is provided with a slit-shaped opening 144 which extends in the radial direction relative to axis 16 and which has a width of, for example 3 mm in the direction normal to the drawings. In the representation of FIG. 2, the openings are situated alternately on the right-hand side and the left-had side, so that the openings 144 in two successive discs are 180° offset (with reference to the axis 16). The discs 142 closest to section 12 are closer to one another in the axial direction than those discs which are further from section 12.

The end of the cooling device 14 which is remote from the end face of the bearing portion 8 opens into a section 145 having a larger diameter. A cooling medium supply duct 17 is received in this section, the duct also being made of metal, its outer diameter being adapted to mate with the inner diameter of the section 145.

During operation, the cooling medium flow, (denoted by the arrow 18) flows through the supply duct 17 into the tube 141 and emerges from the tube 141 through the opening 143 at the area of the end face 13 of the bearing portion 8. The emerging cooling medium is divided into two flows which flow around the tube 141 in opposite directions in a semi-circle until they reach the opening 144 of the first disc 142. On the other side of the tube 141, the flows merge and pass through the opening 144'. After having passed through the opening 144', two cooling medium flows are formed again, the flows again flow around the tube in a semi-circle until they reach the opening 144" in the next disc etc., until the cooling medium ultimately emerges from the opening in the last (lowest) disc furthest from face 13" and is fed back to the cooling medium circuit in a manner not shown.

If the discs 142 with their openings 144 were absent, the cooling medium would flow in an essentially laminar fashion in a direction parallel the axis 16 and along the inner walls of the bearing portion 8 to be cooled. The cooling effect would be slight. The discs cause turbulences in the cooling medium flow, i.e. turbulences which are stronger as the discs are arranged nearer to one another. At these areas, i.e., at the area of the section 12, the strongest cooling effect occurs. It follows from the foregoing that the cooling device itself does not primarily serve to dissipate the heat, but rather serves to provide a turbulent cooling medium flow ensuring a suitable dissipation of heat.

The cooling medium supply duct 17 may be arranged inside a high-voltage connector (not shown) which is introduced into an opening in the insulator 4. A compression spring 19, enclosing the supply duct 17 and bearing against the connector, presses the cooling device 14 against the end face 13 of the bearing portion 8. Consequently, an electrically conductive connection is established between the high-voltage connector and the anode disc 5, via the supply duct 17, the cooling device 14, the bearing portion 8, the lubricant and the rotating bearing portion 9, which connection can serve to connect the anode disc 5 to a positive high voltage.

What is claimed is:

1. An X-ray tube construction comprising:

an anode member having a cylindrical cavity; and cooling means in the cavity comprising:

a first tube dimensioned to be located in the cavity and having an outer face spaced from the cavity wall; and cooling medium guide means secured to the tube outer face for causing cooling medium to flow around the tube in the space between said outer face and cavity wall;

said cavity having a longitudinal axis, the cooling medium guide means comprising a plurality of discs which extend transversely said longitudinal axis, each disc having an opening for the passage of the cooling medium, the openings of neighboring discs being approximately 180° offset with respect to one another relative to said axis.

2. An X-ray tube as claimed in claim 1, wherein the anode member exhibits different temperatures along said axis, the discs being at different distances from one another, the spacings between neighboring discs being the smallest at areas where the anode member has the highest temperature.

3. An X-ray tube as claimed in claim 2 wherein the anode member includes a rotary anode which is journalled by a bearing which comprises a rotating bearing portion and a stationary bearing portion, said cooling medium being present adjacent to the bearing portions, said stationary bearing portion having a cylindrical cavity in which the cooling means are received.

4. An X-ray tube as claimed in claim 1 wherein the anode member includes a rotary anode which is journalled by a bearing which comprises a rotating bearing portion and a stationary bearing portion, said cooling medium being present adjacent to the bearing portions, said stationary bearing portion having a cylindrical cavity in which the cooling means are received.

5. An X-ray tube as claimed in claim 4 including means for receiving a high voltage and for applying the voltage to the anode via the first tube.

6. An X-ray tube as claimed in claim 4 wherein said bearing comprises a helical groove bearing, the cooling means being adapted to provide maximum cooling in the vicinity of the bearing.

7. An X-ray tube as claimed in claim 3 including means for receiving a high voltage and for applying the voltage to the anode via the first tube.

8. An X-ray tube as claimed in claim 3 wherein said bearing comprises a helical groove bearing, the cooling means being adapted to provide maximum cooling in the vicinity of the bearing.

9. An X-ray tube as claimed in claim 1 wherein the anode member includes a rotary anode which is journalled by a bearing which comprises a rotating bearing portion and a stationary bearing portion, said cooling medium being present adjacent to the bearing portions, said stationary bearing portion having a cylindrical cavity in which the cooling means are received.

10. An X-ray tube as claimed in claim 9 wherein said bearing comprises a helical groove bearing, the cooling means being adapted to provide maximum cooling in the vicinity of the bearing.

11. An X-ray tube as claimed in claim 9 including means for receiving a high voltage and for applying the voltage to the anode via the first tube.

* * * * *